United States Patent [19]

Nobel et al.

[11] 3,972,787

[45] Aug. 3, 1976

[54] PALLADIUM ELECTROLYTE BATHS UTILIZING QUATERNIZED PYRIDINE COMPOUNDS AS BRIGHTENERS

[75] Inventors: Fred I. Nobel, Roslyn; John McCaskie, North Merrick, both of N.Y.

[73] Assignee: Lea-Ronal, Inc., Freeport, N.Y.

[22] Filed: June 13, 1975

[21] Appl. No.: 586,711

Related U.S. Application Data

[63] Continuation-in-part of Ser. No. 479,501, June 14, 1974, abandoned.

[52] U.S. Cl. ..... 204/47

[51] Int. Cl.[2] ..... C25D 3/52

[58] Field of Search ..... 204/47, 43 N, 109, 123; 106/1

[56] References Cited

UNITED STATES PATENTS 3,458,409 7/1969 Hayashi et al. ..... 204/43 N

OTHER PUBLICATIONS

B435,844, Jan. 1975, Skomoroski et al., 204/43 N.

*Primary Examiner*—G. L. Kaplan

*Attorney, Agent, or Firm*—Pennie & Edmonds

[57] ABSTRACT

Water soluble quarternized pyridine salts are used in amounts from about 0.001 g/l up to their solubility limit of about 10 g/l in aqueous palladium electrolyte plating baths to greatly enhance brightness even to the point of brilliance.

14 Claims, No Drawings

PALLADIUM ELECTROLYTE BATHS UTILIZING QUATERNIZED PYRIDINE COMPOUNDS AS BRIGHTENERS

This application is a continuation-in-part of application Ser. No. 479,501, filed June 14, 1974, now abandoned.

PRIOR ART

It has previously been proposed, for example, in U.S. Pat. No. 3,458,409 to use pyridine carboxylic acid or pyridine carboxylic acid amine as a brightener for aqueous palladium electrolyte baths. While pyridine is disclosed as a brightener in this patent, the lower limit thereof that may be used is 0.8 g/l and, further more, there are severe limitations as to pH. Further, said patent discloses the need to incorporate auxiliary brightening agents such as a lead chelate.

BRIEF DESCRIPTION OF THE INVENTION

It has been found that water soluble quarternized salts can be advantageously used as brighteners in palladium electrolyte baths in quantities as low as from 0.001 g/l up to their solubility limit of about 10 g/l. A number of different palladium plating baths as hereinafter disclosed have been used and in all instances the quarternized pyridinium salts have been found to be successful brighteners. The water soluble quarternized pyridinium salts which have been found useful are those which in solution provide a pyridinium cation and an anion corresponding to the following general formula

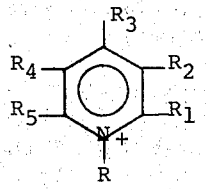

$Y^-$ I in which R is benzyl; or a saturated or unsaturated, straight, branched or cyclic $C_1 - C_6$ alkyl or alkylol, or a poly alkylene oxide radical having at least 2 units (the upper limit of the total number of units is not known, it being only necessary that the salt be soluble in water; however, 2–4 units is presently preferred when this moiety is used). $R_1$, $R_2$, $R_3$, $R_4$ and $R_5$ each is a hydrogen atom or a halogen atom or a lower alkyl, alkenyl, hydroxyl, carboxyl, amino, lower alkylol, lower alkylcarboxyl, lower alkylamine or lower alkylol amino group or a group resulting from the reaction of the hydroxyl, carboxyl, amino, lower alkylol, lower alkylcarboxyl or lower alkylamine group with alkyl sultone, alkyl lactone or an epoxide. In particular, any hydrogen on the carbons of the pyridinium can be substituted by a secondary amino group substituted with a polyalkylene oxide radical or $\beta$-hydroxy polyalkylene oxide radical having at least 2 units. Exemplarily, it is preferred to use as such a substituting secondary amino group $$-NH-(CH_2-\underset{\underset{OH}{|}}{CH}-CH_2-O)_yH$$

in which $y$ is at least 1; the upper limit of $y$ is not known it being only necessary that the salt be soluble in water. A value of 1–4 for $y$ is presently preferred.

Since the functioning moiety in the palladium baths is the quarternized pyridinium cation, any water soluble salt giving a quarternized pyridinium ion as above described can be used. Any anion ($Y^-$) can be used provided the pyridinium salt thereof is water soluble. Anions, $Y^-$, which have been found particularly useful are halogen atoms, tosylates, mesylates and benzene sulfonates.

Exemplarily among the quarternized alkyl groups which can be used are methyl, ethyl, n-propyl, iso-propyl, n-butyl, iso-butyl, sec. butyl, tert. butyl, amyl, hexyl, cyclohexyl and the like. Among the unsaturated alkyl groups, for example, vinyl, allyl, isopropenyl, n-butenyl, iso-butenyl, sec. butenyl, tert. butenyl, propargyl and the like can be used. Among the polyalkylene oxide or alkylol groups that can be used are $-(CH_2-CH_2-O)_xH$, $-(CH_2-CH_2-CH_2-O)_xH$, and $$-(CH_2-\underset{\underset{OH}{|}}{CH}-CH_2-O)_xH$$

where $x$ is at least 1 and preferably 1–4.

Specifically, the following quarternized pyridinium salts have been tried and found to provide excellent brightness in aqueous palladium plating baths.

1. N-benzyl-3-carboxypyridinium chloride
2. N-methyl-3-carboxypyridinium chloride
3. N-allyl-3-carboxypyridinium chloride
4. N-benzyl-3-carboxamidopyridinium chloride
5. N-allyl-2-methyl-5-vinylpyridinium bromide
6. N-methyl-3-carboxypyridinium tosylate
7. N-methyl-2-methyl-5-ethylpyridinium mesylate
8. N-methyl-2-vinylpyridinium benzene sulfonate
9. N-allylpyridinium bromide
10. N-[poly(2-hydroxypropoxy)]-3-carboxypyridinium chloride
11. N-[poly(2-hydroxypropoxy)]-2-aminopyridinium chloride
12. N-[poly(2-hydroxypropoxy)]-2-polyhydroxypropoxy amino pyridinium chloride In utilizing these quarternized pyridinium salts in electrolyte baths the quantity used is from 0.001 g/l up to their solubility limit of about 10 g/l with the amount required depending upon the particular compound used and the degree of brightness desired. As a general rule, the higher the concentration the greater the brightness until a maximum is reached after which point excess brightener presents difficulties in low current density areas.

These brighteners have been tried successfully in several palladium plating solutions including the following. In each of the solutions below the concentration of the brightener used was $2 \times 10^{-4}$ mols/liter.

Additionally, the amps per square foot range over which brightness was demonstrated was 0.1 to 40 except for Example 5 in which the a/sf was 0.1 to 50.

It will be appreciated that the higher the current density achievable with brightness the faster the plating. It has been found that when using palladium at a concentration of 8 to 10 g/l it is possible to use a current density as high as 40–50 a/sf and retain excellent brightness. Still higher a/sf values are possible with these brighteners when the concentration of palladium exceeds 10 g/l. With these brighteners and with palladium at a concentration at 20 g/l it is possible to plate at from 500–1000 a/sf at 50°C and still retain superb brightness. If attempts are made to plate without the brighteners as herein disclosed and claimed the panel shows a dull grey above 4 a/sf at the pH and temperatures disclosed for the solutions 1 – 5 below:

| | |
|---|---|
| Solution No. 1 | |
| Palladium chloride | 12.5 g/l |
| Ammonium chloride | 12.5 g/l |
| Ethylene diamine tetra acetic acid disodium salt | 110 g/l |
| Ammonium hydroxide sufficient to adjust pH to 8 | |
| Brightener No. 1 above | |
| Temperature | 45°C |
| Solution No. 2 | |
| Palladium metal as palladium chloride | 7 g/l |
| Potassium hydroxide | 200 g/l |
| Brightener No. 2 above | |
| Temperature | 80°C |
| pH | about 14 |
| Solution No. 3 | |
| Palladium metal as palladium ammonium nitrate | 6.5 g/l |
| Sulfamic acid | 120 g/l |
| Brightener No. 7 above | |
| Ammonium hydroxide sufficient to raise pH to 7 | |
| Temperature | Room Temp. |
| Solution No. 4 | |
| Palladium metal as palladium chloride | 10 g/l |
| Potassium pyrophosphate | 120 g/l |
| Ammonium chloride | 60 g/l |
| Brightener No. 6 above | |
| Ammonium hydroxide sufficient to raise pH to 7.5 | |
| Temperature | 50°C |
| Solution No. 5 | |
| Palladium metal as palladium chloride | 10 g/l |
| Ammonium phosphate | 145 g/l |
| Brightener No. 3 above | |
| Ammonium hydroxide sufficient to raise pH to 7.5 | |
| Temperature | 50°C |

Still other baths in which these quarternized pyridine compounds may be successfully used are set forth at page 539 of the June, 1965 issue of *Plating* in an article entitled "Palladium Plating-Processes and Applications of the United Kingdom" by F. H. Reid. The brighteners of the class herein disclosed work very well in all of the baths set forth at page 539 therein.

The pH of the palladium baths in which these brighteners produce excellent results can vary between pH 4 and pH 14 with pH 7.5–8.5 being preferred.

The palladium plating produced using the brighteners herein disclosed produced non-porous plate finishes that even directly out of the bath have no pores. Additionally, the ductility of the finishes produced using these brighteners is improved.

We claim:

1. An aqueous electrolytic palladium plating bath having a pH of between about 4 and 14 and containing a palladium compound capable of being electrolytically plated and a water soluble quarternized pyridinium brightening agent in an amount of about 0.001 g/l up to their solubility limit of about 10 g/l which in said bath provides a cation of the formula

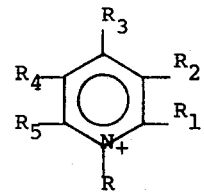

in which R is a benzyl radical, a saturated or unsaturated straight, branched or cyclic $C_1$–$C_6$ aliphatic or hydroxyaliphatic radical or a polyalkylene oxide radical and $R_1$, $R_2$, $R_3$, $R_4$ and $R_5$ each is a hydrogen atom or a halogen atom or a lower alkyl, lower alkenyl, hydroxyl, carboxyl, amino, lower alkylol, lower alkylcarboxyl, lower alkylamine, lower alkylol amino group or a group resulting from the reaction of the hydroxyl, carboxyl, amino, lower alkylol, lower alkylcarboxyl or lower alkylamine group with an alkyl sultone, an alkyl lactone or an epoxide.

2. The palladium plating bath of claim 1 in which said brightener in solution in said bath provides an anion which is a halogen atom or a tosylate, a mesylate, or a benzene sulfonate.

3. The palladium plating bath of claim 2 in which said brightener is N-benzyl-3-carboxypyridinium chloride.

4. The palladium plating bath of claim 2 in which said brightener is N-methyl-3-carboxypyridinium chloride.

5. The palladium plating bath of claim 2 in which said brightener is N-allyl-3-carboxypyridinium chloride.

6. The palladium plating bath of claim 2 in which said brightener is N-benzyl-3-carboxamidopyridinium chloride.

7. The palladium plating bath of claim 2 in which said brightener is N-allyl-2-methyl-5vinylpyridinium bromide.

8. The palladium plating bath of claim 2 in which said brightener is N-methyl-3-carboxypyridinium tosylate.

9. The palladium plating bath of claim 2 in which said brightener is N-methyl-2-methyl-5-ethylpyridinium mesylate.

10. The palladium plating bath of claim 2 in which said brightener is N-methyl-2-vinylpyridinium benzene sulfonate.

11. The palladium plating bath of claim 2 in which said brightener is N-allylpyridinium bromide.

12. The palladium plating bath of claim 2 in which said brightener is N-[poly(2-hydroxypropoxy)]-3-carboxypyridinium chloride.

13. The palladium plating bath of claim 2 in which said brightener is N-[poly(2-hydroxypropoxy)]-2-aminopyridinium chloride.

14. The palladium plating bath of claim 2 in which said brightener is N-[poly(2-hydroxypropoxy)]-2-polyhydroxypropoxy amino pyridinium chloride.

* * * * *